US006616372B2

(12) United States Patent
Seroka et al.

(10) Patent No.: US 6,616,372 B2
(45) Date of Patent: Sep. 9, 2003

(54) PROCESS FOR MAKING PRODUCTS USING WATERJET TECHNOLOGY AND COMPUTER SOFTWARE

(76) Inventors: John M. Seroka, 380 Fairview Rd., Medford, NJ (US) 08050; Joseph E. Nichiporuk, 329 Manor La., Marlton, NJ (US) 08053

( * ) Notice: Subject to any disclaimer, the term of this patent is extended or adjusted under 35 U.S.C. 154(b) by 0 days.

(21) Appl. No.: 09/909,503

(22) Filed: Jul. 20, 2001

(65) Prior Publication Data

US 2002/0044827 A1 Apr. 18, 2002

Related U.S. Application Data

(60) Provisional application No. 60/219,603, filed on Jul. 21, 2000.

(51) Int. Cl.[7] ..... E01C 5/00
(52) U.S. Cl. ..... 404/72
(58) Field of Search ..... 404/17, 34, 41, 404/42, 72; 700/117; 83/13, 76.1

(56) References Cited

U.S. PATENT DOCUMENTS

| | | | | | |
|---|---|---|---|---|---|
| 1,072,712 | A | * | 9/1913 | Fournier | 264/261 |
| 2,491,488 | A | * | 12/1949 | Faulwetter | 404/18 |
| 2,509,558 | A | * | 5/1950 | Cadjew | 40/616 |
| 3,985,848 | A | | 10/1976 | Frische et al. | |
| 4,111,490 | A | * | 9/1978 | Liesveld | 299/17 |
| 4,178,820 | A | | 12/1979 | Gerber | |
| 4,369,850 | A | * | 1/1983 | Barker | 175/393 |
| 4,393,449 | A | * | 7/1983 | Takeda et al. | 318/568.1 |
| 4,620,989 | A | * | 11/1986 | Stiegler | 427/289 |
| 4,624,326 | A | * | 11/1986 | Loegel, Jr. | 175/67 |
| 4,646,598 | A | * | 3/1987 | Lineberry et al. | 83/56 |
| 4,683,684 | A | * | 8/1987 | Yie | 451/92 |
| 4,768,709 | A | | 9/1988 | Yie | |
| 5,010,694 | A | | 4/1991 | Agbede | |
| 5,047,187 | A | * | 9/1991 | Banus | 264/71 |
| 5,097,731 | A | * | 3/1992 | Vives et al. | 83/53 |
| 5,117,366 | A | * | 5/1992 | Stong | 451/2 |
| 5,163,777 | A | * | 11/1992 | Krueger et al. | 404/41 |
| 5,185,192 | A | * | 2/1993 | Banus | 428/49 |
| 5,249,884 | A | * | 10/1993 | Widmer | 404/42 |
| 5,291,694 | A | * | 3/1994 | Hosoya et al. | 451/38 |
| 5,339,715 | A | * | 8/1994 | Coleman | 83/177 |
| 5,363,603 | A | * | 11/1994 | Miller et al. | 451/40 |
| 5,533,827 | A | * | 7/1996 | Scheiwiller | 404/38 |
| 5,568,391 | A | * | 10/1996 | Mckee | 700/122 |
| 5,584,016 | A | * | 12/1996 | Varghese et al. | 345/853 |
| 5,697,413 | A | | 12/1997 | Fuller | |
| 5,765,924 | A | * | 6/1998 | Liesveld | 299/15 |
| 5,884,445 | A | * | 3/1999 | Woolford | 404/41 |
| 5,945,181 | A | | 8/1999 | Fisher | |
| 6,073,058 | A | | 6/2000 | Cossen et al. | |

* cited by examiner

*Primary Examiner*—Gary S. Hartmann
(74) *Attorney, Agent, or Firm*—Knoble & Yoshida, LLC

(57) ABSTRACT

A kit of components and a process which combines the use of water cutting and computer software to create design art images for insertion in interlocking pavers that can interlock with pre-manufactured pavers.

6 Claims, 2 Drawing Sheets

PROCESS FOR MAKING PRODUCTS USING WATERJET TECHNOLOGY AND COMPUTER SOFTWARE

The present utility patent application claims priority under 35 U.S.C. §119 (e) from U.S. Provisional Patent Application Ser. No. 60/219,603 filed on Jul. 21, 2000.

BACKGROUND OF THE INVENTION

1. Field of Invention

The present invention relates generally to a process combining waterjet technology with computer software for making predetermined products.

In particular, the present invention relates to a novel and unique process using waterjet cutting technology and customized computer software for producing predetermined products which include, but are not limited to, artwork, graphics, borders, logos, and custom designs utilizing dyed, colored, and/or stained cementitious, masonry raw product, or interlocking paver materials.

2. Description of the Prior Art

Due to the limited designs and shapes available in the field of interlocking segmented paver systems, any type of artistic or art design is extremely costly and time-consuming to accomplish. It is an objective of certain embodiments of the present invention to accomplish this while producing any desired complex shape or artwork with a minimum of effort.

Furthermore, oftentimes, it is necessary to cut or otherwise form products and/or materials as alluded to hereinabove without burning, melting, or cracking them.

Conventional techniques addressing this problem have proved inadequate, complicated, bulky, and/or expensive.

U.S. Pat. No. 5,945,181 to Fisher discloses tessellatable elements, such as tiles or paving stones, for pedestrian walks, driveways, decorations, patterns on fabrics and within computer software, computer simulation, computer displays, etc. The tessellatable paving elements may be made of clay, concrete, stone, marble, and other materials depending on the application. The multi-sided geometry of the elements forming the tessellations provides an interlocking effect. The present invention, in addition to eliminating and/or avoiding the problems and disadvantages attendant to the conventional devices and techniques, provides a novel, simple, and inexpensive process possessing very new and desirable features, heretofore unattained.

It is another objective of certain embodiments of the present invention to avoid the deficiency of the conventional devices and techniques.

Additional objects, features, and advantages of the invention will become apparent from the following detailed description and accompanying drawing.

SUMMARY OF THE INVENTION

In a first aspect, the present invention provides a process for producing paving components with suitable shapes from paving stones when installed together at a predetermined order forming a predetermined product with a predetermined design selected from the group consisting of artwork, graphics, borders, logos, and custom designs. The process of the present invention comprises the steps of: inputting the predetermined design into a software program included in a cutting tool; and cutting the paving stones into the paving components with suitable shapes using the cutting tool controlled by the software program inputted with the predetermined design, so that the paving components forms the predetermined product with the predetermined design when installed together;

In a second aspect, the present invention provides an paving system comprising a plurality of paving components. Each of the paving components has a suitable shape and comprises an paving stone selected from the group consisting of a cementitious paving material, a masonry paving material, and an interlocking paving material. When the plurality of paving components installed together in a proper arrangement, the plurality of paving components form a predetermined design. The paving components are positioned in at least one layer to facilitate the installation thereof to form the predetermined design. In a third aspect, the present invention provides a process for producing a predetermined product with a predetermined design selected from the group consisting of artwork, graphics, borders, logos, and custom designs from paving stones. The process of the present invention comprising the steps of: inputting the predetermined design into a software program included in a cutting tool; and cutting the paving stones into the paving components with suitable shapes using the cutting tool controlled by the software program inputted with the predetermined design, so that the paving components forms the predetermined product with the predetermined design when installed; and installing the paving components in a predetermined arrangement into an inlay which may be placed in a project of concrete, asphalt, or pavers.

DETAILED DESCRIPTION OF THE PREFERRED EMBODIMENTS

Due to the limited designs and shapes available in the field of interlocking segmented paver systems, it is extremely costly and time-consuming, and in certain situations difficult, to incorporate in such paver systems any type of artistic or art design.

However, in accordance with a preferred embodiment of the present invention, computer software is combined with point-to-point waterjet machines to cut and/or form any design or image which can be scanned and/or inputted into a computer.

Utilizing the novel process in accordance with the present invention, any requested and/or desired artwork, images and/or designs can be cut and/or formed into concrete pavers and/or any desired cementitious products.

Pursuant to the present invention, any predetermined image can preferably, but not necessarily, be made to any desired size and/or edited in appearance by the computer software. Preferably, but not necessarily, the desired image can be placed within its own field of pavers so that it would actually become an inlay which can be placed in any project of concrete, asphalt, or an existing paver project.

As an alternative, the image can be custom tailored to the particular paver pattern being used.

The novel process in accordance with the present invention will be explained further hereinbelow.

In utilizing the novel process in production, a design would be created or alternatively a design would be received from a supplier, installer, and/or customer. Then, such design would be loaded into a predetermined software program.

The predetermined software program would then place the design or image within the field of predetermined programmed pavers, and will then determine the amount of pavers or paving stones required for such design or image and in what order by size and/or color.

Figure 2:
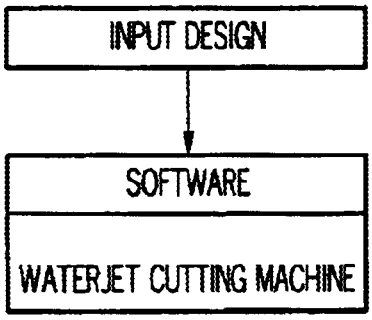
FIG. 2 is a schematic representation of a waterjet cutting machine and its programming.

In accordance with one particular embodiment of the present invention, the pavers or paving stones would then be fed into a waterjet machine. Such a waterjet machine may be any suitable machine including, but not limited to, a Bengal Abrasive Watedjet Machine, an Ingersoll-Rand Waterjet Cutting Machine, etc. A waterjet machine is shown schematically in FIG. 2.

As the pieces are cut, they are placed into a proper order for packaging. The pieces of paver or paving stone can be numbered and/or stacked according to the order of paving, which may include a diagram with the corresponding numbered design or image.

The paving stone is typically made from concrete and meets certain ASTM standards such as having a minimum compressive strength of 8,000 psi (about 3 times stronger than regular poured concrete) and a maximum water absorption rate of 5%.

Designs and/or kits of components (an paving system) may preferably, but not necessarily, be placed in layers to protect the product, and then shrink-wrapped for shipping. Such kits of components may preferably, but not necessarily, be palletized by weight for transport and maneuvering in the field.

The aforementioned kits of components may incorporate any design or image which can be delivered and installed directly from the pallet. An exemplary kit of components is illustrated in the accompanying drawing.

Figure 1:
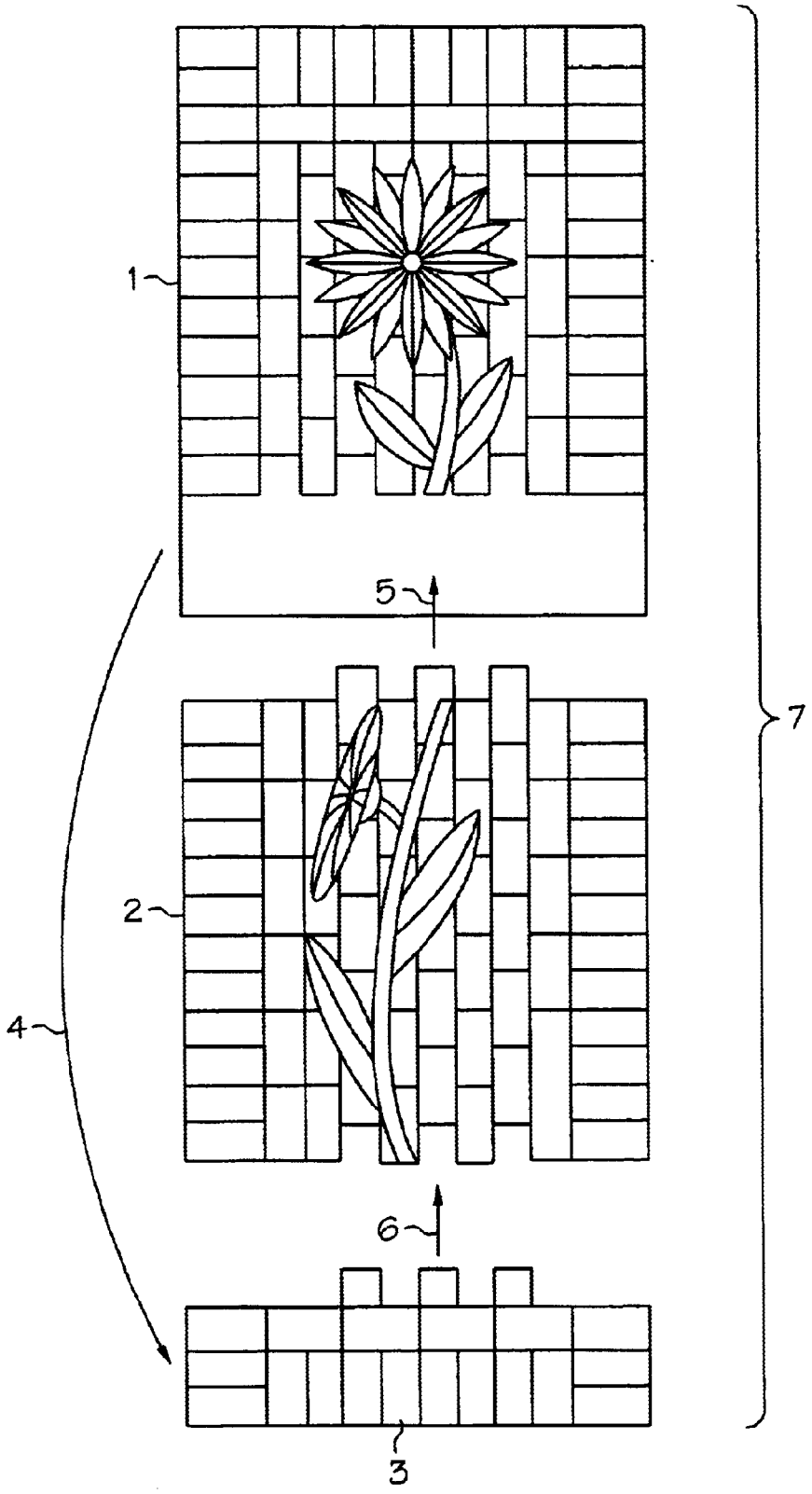
FIG. 1 illustrates a top plan view depicting an paving system (a kit of components) and how they are joined together according to the present invention.

FIG. 1 of the drawing depicts a first kit of components I which comprises a first predetermined portion of a desired overall design 7.

FIG. 1 of the drawing also illustrates a second or add-on kit of components 2 which comprises a second predetermined portion of the desired overall design 7.

The first kit of components 1 may preferably, but not necessarily, include a predetermined end portion 3 which may initially arrive on a pallet to the job site temporarily interlocked or contiguous with the main portion of said first kit of components 1. During installation, said predetermined end portion 3 may be moved away from said main portion of said first kit of components 1 as indicated in FIG. 1 of the drawing by the directional arrow 4.

The second or add-on kit of components 2 can then be linearly translated or otherwise moved, as indicated in FIG. 1 of the drawing by the directional arrow 5, to join together and/or interlock with said main portion of said first kit of components 1.

The predetermined end portion 3 can then be linearly translated or otherwise moved, as indicated in FIG. 1 of the drawing by the directional arrow 6, to join together and/or interlock with the rear portion of the second or add-on kit of components 2, to thus form the aforementioned desired overall design 7.

In accordance with the present invention, additional kits of components can be fabricated to add on to other kits of components, such as, for example, the kits of components 1 and 2 which are illustrated in the accompanying drawing and explained hereinabove.

Such kits of components may comprise entire walkways and/or driveways delivered complete to any location.

One important feature of the present invention is that almost any image or design can be produced by the novel process. Such a design may vary from a single rose in a walkway to an entire complex theme.

Alternate embodiments of the present invention may include performing the novel process with portable waterjet machines in the field and/or any desired locale.

The process of the present invention can create artwork and boarders for interlocking pavers which are not currently manufactured and/or otherwise impractical to be made in the field.

Preferably, in the process of the present invention, a water cutting tool and computer software are combined to create designed art images to insert in interlocking pavers which interlock with pre-manufactured pavers.

Preferably, in the process of the present invention, a point-to-point water jet machine is combined with a computer software to cut any image or design which can be inputted or scanned into the computer software.

Preferably, in the process of the present invention, waterjet technology is utilized in combination with a customized computer software to create artwork, graphics, borders, logos, and custom designs using dyed, colored, and/or stained cementitious, masonry raw product or interlocking paver materials to be placed or inlaid within interlocking paver, asphalt, or similar concrete material projects, such as, driveways, patios, walkways, parking areas, town or city squares, public spaces, etc.

Preferably, process of the present invention can also implement letters, numbers, any related directional or traffic signs and symbols, computer generated designs, scanned images, school and park area applications, complex and stadium facility uses, airports, theme parks, commercial advertising and inlaid signage.

Preferably, process of the present invention facilitates and may result in the prepackaging of the kit of components.

Preferably, in the process of the present invention, the waterjet/computer software combination utilizes a stationary waterjet with a moving tray.

Preferably, in the process of the present invention, the waterjet/computer software combination utilizes a stationary tray with a moving waterjet.

Preferably, in the process of the present invention, a portable version of the waterjet machine is used in the field of a project.

Preferably, the process of the present invention utilizes waterjet and/or ultrasonic fabrication for industry and/or architecture.

Figure 3:
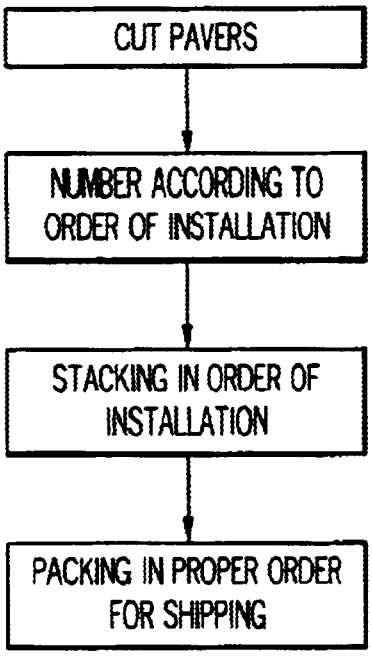
FIG. 3 is a flowchart depicting method steps according to the preferred embodiment of the invention.

Preferably, as shown in FIG. 3, the pavers are cut using the waterjet machine described above, and are numbered according to an order of installation. Then, the pieces are stacked according to an order of installation. The pieces are then packed into a proper order for shipping.

The foregoing description is intended only to be illustrative, but not limiting, of the present invention. It should therefore be understood that many changes, modifications, variations, and other uses and applications will become apparent to those persons skilled in this particular area of technology and to others after having been exposed to the present specification and accompanying drawings. Any and all such changes, modifications, variations, and other uses and applications which do not depart from the spirit and scope of the present invention are therefore covered by and embraced within the present invention and patent application.

The present invention is intended to cover various modifications and equivalent arrangements which come within the scope of the patent claims set forth hereinbelow.

What is claimed is:

1. A process for producing paving components with suitable shapes from paving stones when installed together at a predetermined order forming a predetermined product with a predetermined design selected from the group consisting of artwork, graphics, borders, logos, and custom designs, comprising the steps of:

inputting the predetermined design into a software program included in a waterjet cutting tool; and forming the perimeter of the paving stones by cutting the paving stones into the paving components with suitable shapes using the water jet cutting tool controlled by the software program inputted with the predetermined design, thereby the paving components forms the predetermined product with the predetermined design when installed together, wherein the paving stones are selected from the group consisting of a cementitious paving material, a masonry paving material, and an interlocking paving material, and wherein the paving stones are selected from the group consisting of colored paving stones, dyed paving stones, and stained paving stones.

2. The process according to claim 1, wherein the paving components comprise interlocking pavers which are fabricated to interlock with pre-manufactured pavers.

3. The process according to claim 1 further comprising the step of forming pavement selected from the group consisting of a walkway and a driveway from the paving components.

4. The process according to claim 1 further comprising the step of packing the paving components into a proper order for shipping.

5. The process according to claim 1 further comprising the step of numbering the paving components according to an order of installation.

6. The process according to claim 1 further comprising the step of stacking the paving components according to an order of installation.

* * * * *